United States Patent [19]

Ricketts

[11] Patent Number: 4,805,157

[45] Date of Patent: Feb. 14, 1989

[54] MULTI-LAYERED POLYMER HYDROPHONE ARRAY

[75] Inventor: Donald Ricketts, Scituate, Mass.

[73] Assignee: Raytheon Company, Lexington, Mass.

[21] Appl. No.: 144,659

[22] Filed: Jan. 12, 1988

Related U.S. Application Data

[63] Continuation of Ser. No. 928,679, Nov. 7, 1986, abandoned, which is a continuation of Ser. No. 557,769, Dec. 2, 1983, abandoned.

[51] Int. Cl.[4] ..... H04R 17/00

[52] U.S. Cl. ..... 367/119; 367/155; 367/157; 367/162; 310/337; 310/800

[58] Field of Search ..... 310/313 A, 325-327, 310/337, 340, 345, 348, 357-359, 364-368, 800; 367/119, 138, 152-155, 157, 159-162, 164, 165, 169, 170, 173, 176, 180

[56] References Cited

U.S. PATENT DOCUMENTS

| | | | |
|---|---|---|---|
| 2,636,134 | 4/1953 | Arons et al. | 367/157 X |
| 2,943,297 | 6/1960 | Steinberger et al. | 367/155 |
| 3,521,090 | 7/1970 | Angeloff | 310/359 X |
| 3,590,287 | 6/1971 | Berlincourt | 310/359 X |
| 3,764,848 | 10/1973 | Berlincourt | 310/358 X |
| 3,860,899 | 1/1975 | Watlington | 340/3 T |
| 3,894,169 | 7/1975 | Miller | 367/157 X |
| 3,971,250 | 7/1976 | Taylor | 310/800 X |
| 4,166,229 | 8/1979 | DeReggi et al. | 310/337 |
| 4,245,329 | 1/1981 | Dubois | 367/170 X |
| 4,330,730 | 5/1982 | Kurz et al. | 310/800 X |
| 4,368,401 | 1/1983 | Martin et al. | 310/327 X |
| 4,376,302 | 3/1983 | Miller | 310/358 X |
| 4,381,470 | 4/1983 | Leach et al. | 310/327 |
| 4,461,179 | 7/1984 | Holt | 310/800 X |
| 4,491,760 | 1/1985 | Linvill | 310/800 X |

FOREIGN PATENT DOCUMENTS

| | | | |
|---|---|---|---|
| 0057982 | 8/1982 | European Pat. Off. . | |
| 2271733 | 12/1975 | France . | |
| 0042474 | 3/1980 | Japan | 310/800 |
| 0013784 | 1/1982 | Japan | 310/358 |
| 2013032 | 10/1977 | United Kingdom . | |

OTHER PUBLICATIONS

B. Woodward and R. C. Chandra, "Underwater Acoustic Measurements on Polyvinylidene Fluoride Transducers", Electrcomponent Science and Technology, 1978, vol. 5, pp. 149-157.

Yoram Berlinsky, "Transduction with $PVF_2$ ® in the Ocean Environment", Naval Research Laboratory Report 8365, Mar. 28, 1980.

Patents Abstracts of Japan, vol. 9, No. 35 (E-296)[1758], Feb. 14, 1985; and Jp-A-59 176 992 (Boeicho Gijutsu Kenkyu Honbu) Oct. 6, 1984.

Eascon '79 Record, vol. 3, 1979, IEEE Electronics and Aerospace Systems Convention, Arlington, VA, Sep. 25-27, 1978, pp. 517-523, NY, U.S.; J. M. Powers: "Piezoelectric Polymer-An Emerging Hydrophone Technology".

*Primary Examiner*—Brian S. Steinberger

*Attorney, Agent, or Firm*—Martin M. Santa; Richard M. Sharkansky

[57] ABSTRACT

A piezoelectric polymer (PVDF) hydrophone array consists of multiple layers disposed symmetrically about a stiffener layer. The stiffener layer prevents flexural modes in the operating frequency band and provides a mounting structure for acceleration noise cancellation. The piezoelectric polymer layers are attached to the stiffener layer either directly or through intervening layers which provide mechanical vibration isolation of the polymer and stiffener layers.

18 Claims, 4 Drawing Sheets

MULTI-LAYERED POLYMER HYDROPHONE ARRAY

This application is a continuation of application Ser. No. 928,679, filed Nov. 7, 1986, which is a continuation of application Ser. No. 557,769, filed Dec. 21, 1983, both now abandoned.

BACKGROUND OF THE INVENTION

This invention relates to hydrophone arrays and more particularly to a multi-layered piezoelectric polymer (PVDF) hydrophone array.

In the prior art, piezoelectric ceramics, particularly the lead zirconate titanates (PZT), have been the most commonly used transduction materials in both hydrophones and projectors. Piezoceramic has offered considerable flexibility in hydrophone design, because it can be made in a wide variety of shapes, such as cylinders, rings, plates and hemispheres. While ceramic can be made in different forms, there are practical constraints on the maximum size that can be fabricated in one piece. This is a consequence of the hard and brittle nature of piezoceramic materials. The constrained maximum size, ceramic rigidity, and its high mass density—which is almost equal to the denisty of steel—are disadvantages in some applications; for example, towed arrays and large aperture hull-mounted arrays used on ships.

Piezoelectric polymer (PVDF), a recent development in new transduction materials, overcomes these limitations and has led to the development of light weight, flexible hydrophones. As employed in this invention, PVDF is capable of being fabricated as long strips for application in towed arrays or large flat sheets for use in large aperture arrays. The lower density and mechanical flexibility of polymer have already proved to be advantageous in its use in thin line towed arrays, where the hydrophones must be long, thin, flexible and light weight. A long length hydrophone reduces the noise associated with turbulent boundary layer phenomenon by the method of spatial averaging. This method takes advantage of the slower speed of flow noise than the signal's sound speed which results in turbulent boundary layer noise—but not signal—descrimination. The hydrophone elements of large aperture arrays must also be of large lateral dimensions, light weight, thin, semi-flexible, and capable of descriminating against high wave number turbulent boundary layer noise. Hull-mounted large aperture array hydrophones must also be capable of descriminating against medium-wave number hull vibration noise as in the present invention.

Because of its light weight and mechanical flexibility, polymer is more shock resistant than piezoceramic. Also, the mechanical flexibility of polymer allows the material to conform to irregular surfaces and makes possible new types of hydrophone designs. In addition, the characteristic impedance of polymer more nearly matches that of water. The polymer also has the advantage of having large piezoelectric stress constants.

Piezoelectric polymer film is presently made of polyvinylidene fluoride and is often referred to as PVDF. A polarization procedure must be used to render the polymer usefully piezoelectric. This procedure comprises uni-axially stretching the film at elevated temperatures to several times its original length. In one method of polarization, both surfaces of the film are metallized and a high DC electric field is applied to the electrodes and held for about one hour at 100° C. Subsequent cooling to room temperature under the applied field results in permanent polarization.

SUMMARY OF THE INVENTION

This invention comprises a multi-layered piezoelectric polyvinylidene fluoride polymer (PVDF) hydrophone array which consists of multiple layers of material disposed symmetrically on each side of the middle layer. Structural rigidity is provided by the middle layer for prevention of flexural modes in the operating frequency band. Mounting of the array to the middle layer results in an inertially balanced configuration for acceleration cancelling. The outermost layers of the multi-layered array comprise a PVDF layer with the intervening layers decoupling the PVDF layers from the middle support layer. The metallization pattern on the surfaces of the continuous PVDF layers defines the hydrophone array geometry and the number of elements.

This invention exploits the unique properties of PVDF polymer and the fact that it can be made in large continuous sheets. The invention provides both improved performance and simplicity of construction. The salient features of the invention are: (1) large area, closely spaced multiples of hydrophone elements on a continuous sheet of PVDF, with associated benefits of spatial averaging for noise reduction; (2) an independent sensor layer attached to the middle structural support layer of the array which can be used for noise cancellation; (3) intervening layers between the outer PVDF array layers to provide isolation of the outer signal sensing layers and the support layer and also to provide impedance control of the assembly of layers; (4) an inertially balanced configuration for acceleration cancelling by appropriate electrical connection of the outermost PVDF layers; and (5) hydrostatic mode operation.

BRIEF DESCRIPTION OF THE DRAWINGS

The aforementioned aspects and other features of the invention are explained in the following description taken in conjunction with the accompanying drawings wherein.

DESCRIPTION OF THE PREFERRED EMBODIMENT

Figure 1:
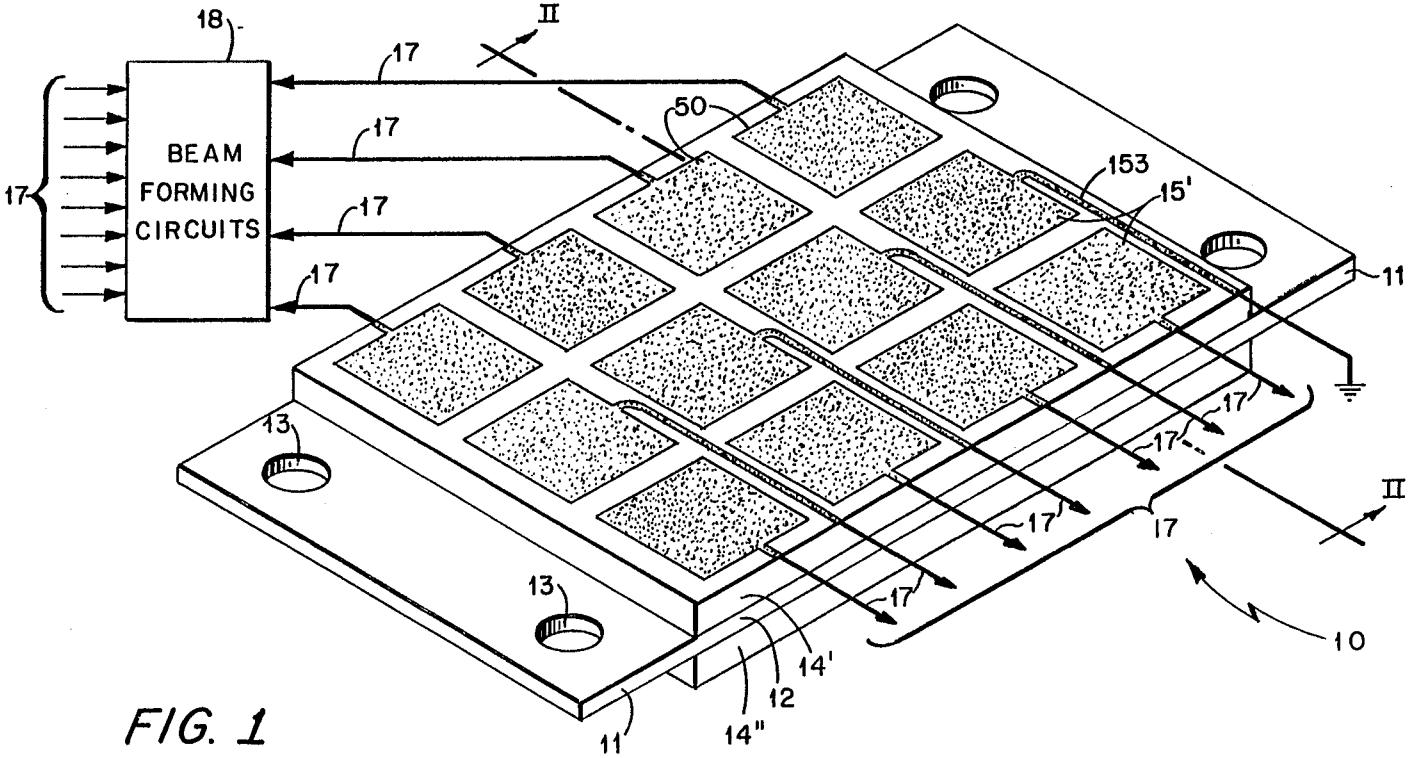
FIG. 1 is an isometric view of a transducer array constructed in accordance with this invention.

A preferred embodiment of this invention is shown in the isometric view of the array 10 shown in FIG. 1. The array assembly 10 has a central stiffening and supporting layer 12 which extends on each end to form a mounting support 11 on each end by which the assembly 10 may be secured by vibration absorbing mounts to a support structure (both not shown). Mounting to reduce structurally transmitted vibration to a transducer is well known in the prior art. The array structure 10 also comprises composite layers 14', 14'' above and below, respectively, the supporting layer 12. The electrodes 15' and corresponding opposed electrodes 15'' on the other side of layers 14', 14'' (now shown in FIG. 1)

form transducer elements 50 which are connected by wires 17 to conventional beam forming circuits 18. Although only the electrically conducting regions or electrodes 15' on the outer surface of the layer 14' are shown in FIG. 1, it should be understood that a corresponding patterns of electrodes 15', 15'' appear on the outer and inner surfaces of the other composite layer 14'' and are not observable in the isometric view of FIG. 1.

Figure 2:
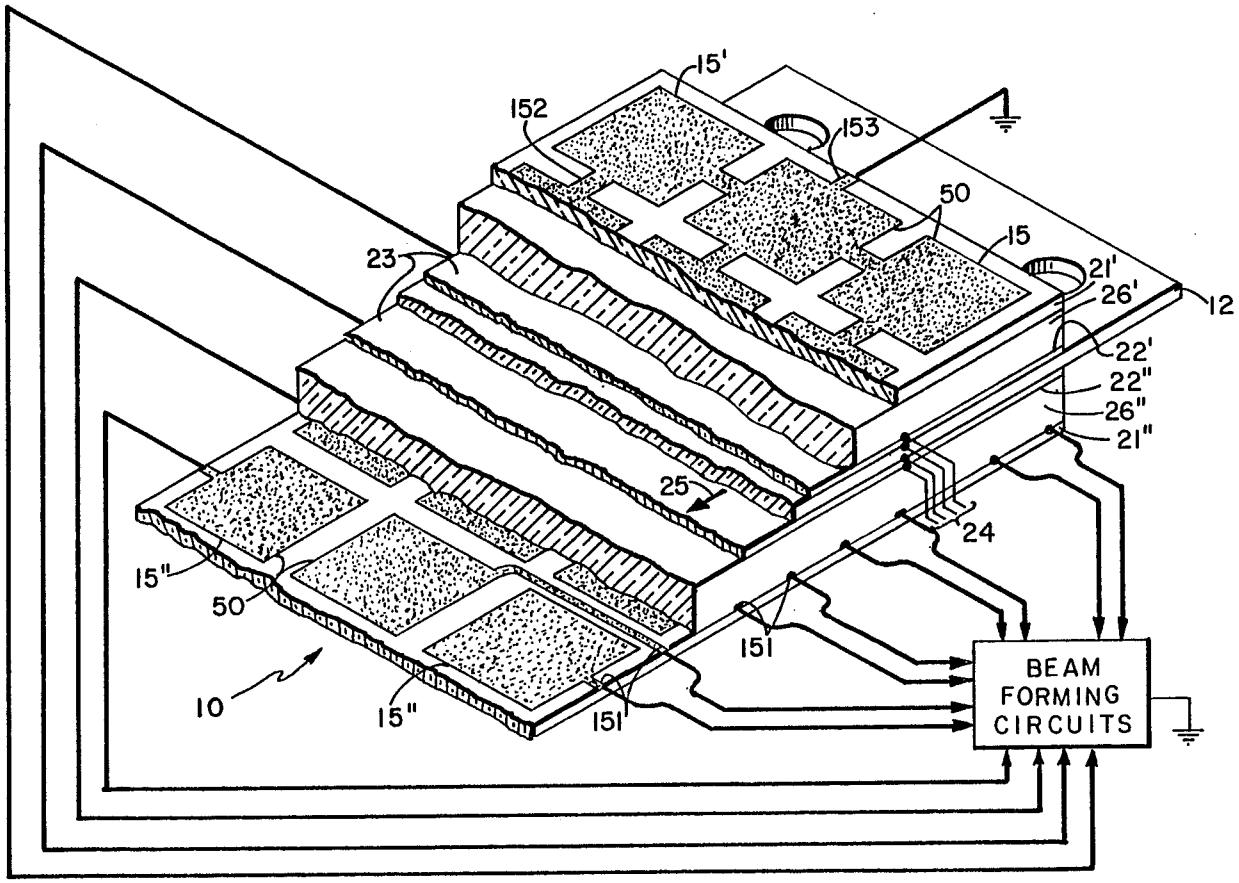
FIG. 2 is a cross-sectional view of FIG. 1 at section lines II—II.

A sectional view along the section lines II—II of a modified embodiment of the array 10 of FIG. 1 is shown in FIG. 2 where the sectioning is longitudinally displaced on each layer in order to more clearly illustrate the invention. The embodiment of FIG. 2 shows three layers 21', 22', 24' forming the composite layer 14'. Composite layer 14'' is identical to layer 14'. The center support layer 12 provides the structural rigidity for prevention of flexural modes in the operating frequency band of the transducer array 10. Layer 12 also provides a mounting structure for the hydrophone array 10 to provide an inertially balanced configuration for acceleration cancelling. A suitable material for the support layer 12 is a glass fiber reinforced resin, commercially available type G-10 is suitable. The high stiffness and the low density of the glass fiber reinforced resin layer 12 causes the array to be resistant to flexural stresses and also contributes to the light weight of the array. However, other plastics having these properties and metals such as aluminum or steel may be used in other embodiments.

The outermost layers 21', 21'' are a thick film PVDF material with maximum sensitivity to stress in the direction transverse to the plane. The layers 21', 21'' constitute the primary electromechanically active layers of the hydrophone array 10. The electrodes 15', the corresponding electrodes 15'' on the inner surface of layers 21', 21'' (shown in FIG. 2 on the inner surface of the PVDF layer 21''), together with the intervening PVDF layers 21', 21'' form the transducer elements 50 of the array 10. Corresponding regions 15'' of layers 21', 21'' are connected in parallel and provided to beam forming circuits as in conventional transducer arrays. The outermost electrodes 15' of the layers 21', 21'' are shown connected together by the electrical conductors 152 and are then connected to a ground by a conductor 153 to thereby form a shield to prevent electrical noise signals from being picked up by the innermost electrodes 15''. Alternatively, the electrodes 15' may, as shown in FIG. 1, be connected by individual wires 17 to beamforming circuits 18 where they are grounded. This alternative connection of wires 17 minimizes crosstalk problems which sometimes occurs when a common ground wire is used as is known in the prior art. The signals provided by electrodes 15'' of the array 10 are provided by wires 151 to the periphery of the array whose electrical connections to conventional beamforming circuitry can be made. The electrodes 15', 15'' and wiring 151, 152, 153 are formed by selective etching of the commercially available metallized PVDF film which is used in layers 21', 21''. Because the PVDF layers 21', 21'' are to be sensitive to pressure variations exerted upon their exterior surfaces the PVDF will be manufactured, in a manner known to those skilled in the art, to have its most sensitive axis of piezoelectricity in the direction transverse to the plane of each layer 21', 21'' and to have maximum thickness (0.040 inch is presently available) for maximum sensitivity to the normal incidence of the acoustic pressure desired to be detected.

The thin film PVDF layers 22', 22'' are bonded to opposite sides of the support layer 12. Each PVDF layer 22', 22'' has an electrically conductive film 23 on each of its sides to which electrical connection is made with wires 24. The thin film polymer layers 22', 22'' are stretched in the direction of direction arrow 25 and is polarized in its thickness direction (transverse to its plane) to provide a film which produces maximum output voltage for strain along direction arrow 25. Thus, the thin film 22', 22'' senses the strain in the support layer 12 and produces a voltage proportional to the strain. Because the film 22', 22'' is thin, typically about 1 mil thickness, and also attached by bonding to support layer 12, the film will be more sensitive to the mechanical vibrations of the layer 12 than to normal incidence acoustic pressure. Biaxially stretched film is also available and could be substituted for uniaxial film in layers 21', 21'', 22', 22''. The signal on wires 24 is provided to the electrical circuitry to which the transducer elements 50 are connected to cancel out the same vibration component of noise which is undesirably detected by each of the transducer elements 50 of the PVDF layers 21', 21''. Since the PVDF layers 22', 22'' are thin and are polarized for maximum sensitivity in the plane of the layers, they do not produce significant output voltage as a result of the compressive stresses produced by the changing water pressure and therefore do not act to diminish the signals produced by the transducer elements 50 of layers 21', 21''. Thus, the output voltage on lines 24 of the noise sensing layers 22', 22'' is proportional to the surface strains of the support layer 12.

The layers 26', 26'' are bonded by a glue or other suitable bonding material to the outermost layers 21', 21'' and the innermost layers 22', 22'', respectively. The layers 26', 26'' have a dual purpose. They serve the function of electrically insulating the outer layer 21' from the inner layer 22' but are intended primarily for decoupling of the hydrophones of layers 21', 21'' from the central supporting layer 12. Because of its high damping factor, polarized or unpolarized PVDF polymer is a suitable material for layers 26', 26''. Since the impedance of polarized or unpolarized PVDF is close to that of water and because of the high damping factor, the impedance provided by the transducer array 10 is close to that of water. Because of the close impedance match, scattering effects are reduced thereby resulting in better defined beams.

Figure 3:
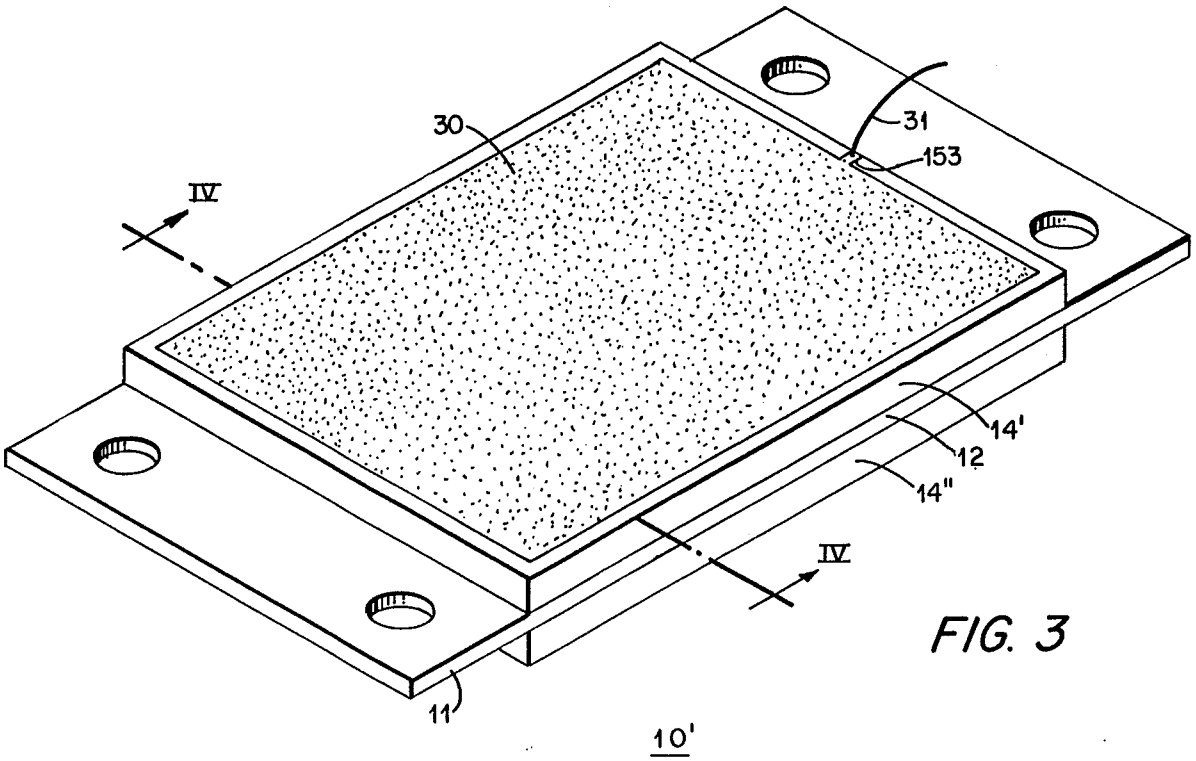
FIG. 3 is an isometric view of another embodiment of the invention.

FIG. 3 shows an isometric view of a transducer array 10' similar to the array 10 of FIG. 1 but differing in having its outermost electrically conductive film 30 be a continuous film which is not patterned to form the electrodes 15' as shown in FIG. 1. The transducer elements 50 (not shown in FIG. 3) are therefore defined by the electrically conducting electrodes 15'' on the interior surface of the outermost PVDF layers 21', 21''. The acoustic performance of the transducer array of FIG. 3 is comparable to that of the transducer array of FIG. 1 while providing equivalent electrical shielding because of the simpler continuous coverage of film 30 which is grounded by electrical wire 31.

Figure 4:
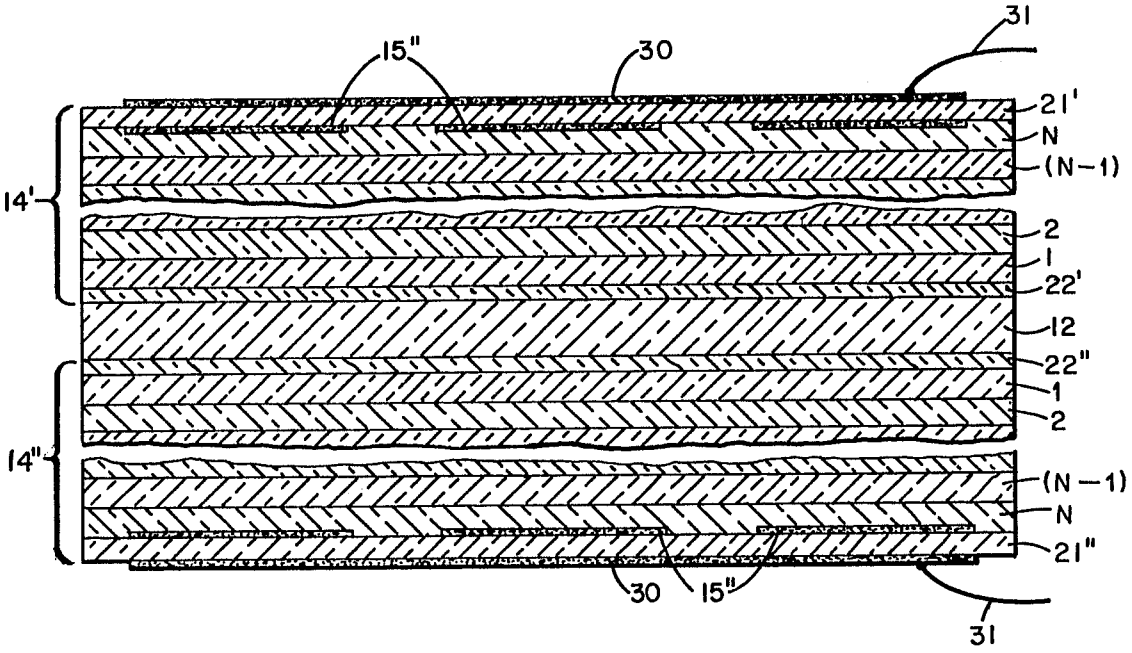
FIG. 4 is a cross-sectional view of the embodiment of FIG. 3 along the section lines IV—IV.

FIG. 4 shows a cross-sectional view at section lines IV—IV of the transducer array of FIG. 3 for the case where the composite layers 14', 14'' have more than the three constituent layers shown in FIG. 2. In particular, N layers are provided between the outermost PVDF layers 21', 21'' and the innermost PVDF layers 22', 22'', respectively (a total of 2N layers), instead of the single layers 26', 26'', shown in FIG. 2. The N layers [layers 1, 2 . . . (N−1), N], which may include glue layers (bonding medium layers) if they are of acoustic significance, are chosen to provide damping between the outermost PVDF layers 21', 21'' and the support layer 12 and also chosen to provide an impedance match with the water of the layers 21', 21'' in accordance with well-known impedance matching techniques using multiple layers of materials. The N layers are symmetrically disposed about the middle supporting layer 12 with regard to both layer thickness and layer properties. The layers 1 through N can be isotropic or orthotropic and include PVDF damping (or decoupling) layers. It should be noted that the cross-sectional view of FIG. 4 shows the continuous electrical film 30 on the outermost surface of the PVDF layers 21', 21''.

As previously mentioned, the metallized patterns 15', 15'' on the PVDF layers 21', 21'' of FIGS. 1 and 2 define the array configuration with each pair of opposed discrete metallized surfaces 15', 15'' and their intermediate PVDF material constituting a hydrophone element 16. The same metallized pattern appears on both sides of these layers in the embodiment of FIGS. 1 and 2. Although the shape of each hydrophone element is arbitrary, a high density packing factor is desired to gain the noise reduction benefits of spatial averaging. A square or rectangular pattern would satisfy this requirement with small unmetallized gaps between the elements. The size, number, and grouping of the hydrophone elements are established using well-known receiving array design criteria. The electrical connections are made to the metallized surfaces of each hydrophone element by the electrical conductors 151.

The hydrophone array 10 is waterproofed by a plastic or rubber coating (not shown) which surrounds the array 10 to provide waterproofing of the electrical connections to the array. Since both PVDF layers 21', 21'' are exposed to the acoustic field provided by the water environment in which the array is used, the array 10 operates in the hydrostatic mode, and its sensitivity is determined by the piezoelectric constant $g_h$. The sensitivity of each transducer element 50 is the same because of the absence of flexural modes obtained by the support layer 12 which provides the necessary stiffness for the elimination of flexural resonances in the operating frequency band. It is also to be noted that the layers constituting the array 10 are symmetrically disposed about the supporting layer 12 with regard to both layer thickness and layer properties. Thus, corresponding layers may also be isotropic or orthotropic plates. Thus, layer 21' has the same thickness and properties as layer 21'', or more generally layer N' has the same thickness and properties as layer N''.

Having described a preferred embodiment of the invention, it will be apparent to one of skill in the art that other embodiments incorporating its concept may be used. It is felt, therefore, that this invention should not be restricted to the disclosed embodiment but rather should be limited only by the spirit and scope of the appended claims.

What is claimed is:

1. A transducer comprising:

a planar support layer having two opposed sides;

said planar support layer being a stiffening layer providing structural rigidity;

piezoelectric polymer first planar layers each having two opposed sides on each said side of said support layer, each of said first piezoelectric layers being bonded to said opposite sides of said support layer, each of said first layers being polarized in the direction transverse to the plane of each of said first layers to provide an electrical signal primarily produced by straining the plane of each of said first layers as a result of mechanical vibrations of said support layer;

second layers bonded to said first layers, each of said second layers being a damping material;

third planar piezoelectric polymer layers each having two opposed sides;

each of said first and third layers having an electrically conductive film bonded to each said side of each of said first and third layers;

each of said piezoelectric polymer third layers bonded to a different one of said second layers, each of said third layers being polarized in the direction transverse to the plane of each of said third layers to provide electrical signals primarily responsive to acoustic signal pressure transverse to the plane of each of said third layers; and said electrically conducting films of each of said first and third layers providing said electrical signals in response to the strain in each of said first and third layers.

2. The transducer of claim 1 wherein each of said second layers is a polymer layer.

3. The transducer of claim 1 wherein each of said second layers is a polyvinylidene fluoride layer.

4. The transducer of claim 1 wherein said support layer is a layer of glass fiber reinforced resin comprising means for providing structural rigidity for prevention of flexural modes in the transducer.

5. The transducer of claim 1 wherein each of said third layers have at least one of said conducting films of each of said third layers patterned to provide electrically isolated regions on at least one surface of each of said third layers, said regions defining transducer elements of an array of transducer elements on each of said third layers.

6. The transducer of claim 5 comprising in addition:

beam forming circuitry;

means connecting to each other the conduction films nearest said support layer of each of said first layers;

means connecting to each other the conduction films farthest from said support layer of each of said first layers;

means connecting to each other the conduction films nearest said support layer of each of said third layers;

means connecting to each other the conduction films farthese from said support layer of each of said third layers; and means connecting said conductive films of said first and third layers to said beamforming circuitry.

7. The transducer of claim 1 wherein:

each of said first layers is a film of polyvinylidene fluoride.

8. The transducer of claim 7 wherein:

each of said first films is substantailly one mil in thickness.

9. The transducer of claim 1 wherein:

each of said third films is a film of polyvinylidene fluoride.

10. The transducer of claim 9 wherein:

the sum of said first film and said third film is substantially 40 mils in thickness.

11. The transducer of claim 1 wherein:

each of said second damping layers is also an electrical insulator.

12. The transducer of claim 11 wherein:

each of said second damping layers is a polyvinylidene fluoride.

13. A transducer array comprising:

a planar support layer having two opposed surfaces;

said planar support layer being a stiffening layer providing structural rigidity;

piezoelectric polymer first planar layers each having two opposed surfaces on each of said surfaces of said support layer, each of said first piezoelectric layers being bonded to a different surface of said support layer, each of said first layers being polarized in the direction transverse to the plane of each of said first layers and providing maximum response to strain in the plane of each of said first layers produced by mechanical vibration of the bonded support layer and being insensitive to strain produced by pressure transverse to the plane of each of said first layers;

second planar layers bonded to said first layers, said second layers being a damping and electrically insulating material;

piezoelectric polymer third planar layers each having two opposed surfaces bonded to each of said second layers, each of said third layers being polarized in the direction transverse to the plane of each of said third layers to be responsive to pressure variations in a direction transverse to the plane of each of said third layers to provide an electrical signal;

said piezoelectric first and third layers having electrically conducting films on both said surfaces of each said first and third layers to provide a voltage across each of said first and third layers in response to the strain across each said first and third layers;

said third layers each having one of its said surfaces bonded to a different one of said surfaces of said second layers;

said one of said surfaces of said third piezoelectric layers having a pattern of electrodes formed by one of its electrically conducting films;

the other electrode on the other surface of each of said third layers electrically connected to ground;

beam forming circuitry;

the electrodes on the one surface of each of said third layers electrically connected to said beamforming circuitry;

one of the conducting films of each of said first layers electrically connected to ground; and the other surface conducting films of each of said first layers electrically connected to said beamforming circuitry.

14. The transducer of claim 13 wherein each of said second layers comprises a plurality of fourth layers of damping material.

15. The transducer of claim 13 wherein:

each of said first layers is a film of polyvinylidene fluoride.

16. The transducer of claim 15 wherein:

each of said first films is substantailly one mil in thickness.

17. The transducer of claim 13 wherein:

each of said third films is a film of polyvinylidene fluoride.

18. The transducer of claim 17 wherein:

the sum of said first film and said third film is substantially 40 mils in thickness.

* * * * *

UNITED STATES PATENT AND TRADEMARK OFFICE

CERTIFICATE OF CORRECTION

PATENT NO. : 4,805,157

DATED : February 14, 1989

INVENTOR(S) : Donald Ricketts

It is certified that error appears in the above-identified patent and that said Letters Patent is hereby corrected as shown below:

Column 1, line 26, delete "denisty" and replace with -- density --.

Column 1, line 45, delete "descrimination" and replace with -- discrimination".

Column 1, line 48, delete "descriminating" and replace with --discriminating --.

Column 1, line 51, delete "descriminating" and replace with -- discriminating --.

Column 6, line 55, delete "farthese" and replace with -- farthest --.

Column 6, line 63, delete "substantailly" and replace with -- substantially --.

UNITED STATES PATENT AND TRADEMARK OFFICE

CERTIFICATE OF CORRECTION

PATENT NO. : 4,805,157

DATED : February 14, 1989

INVENTOR(S) : Donald Ricketts

It is certified that error appears in the above-identified patent and that said Letters Patent is hereby corrected as shown below:

Column 8, line 28, delete "substantailly" and replace with -- substantially --.

Signed and Sealed this

Third Day of October, 1989

*Attest:*

*Attesting Officer*

DONALD J. QUIGG

*Commissioner of Patents and Trademarks*